US007082882B2

(12) United States Patent
Heimbrock

(10) Patent No.: US 7,082,882 B2
(45) Date of Patent: Aug. 1, 2006

(54) FRAME MOUNTED OVERBED TABLE

(75) Inventor: Richard H. Heimbrock, Cincinnati, OH (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 10/639,570

(22) Filed: Aug. 12, 2003

(65) Prior Publication Data

US 2005/0034637 A1 Feb. 17, 2005

(51) Int. Cl.
*A47B 23/00* (2006.01)

(52) U.S. Cl. ..... 108/49; 108/152

(58) Field of Classification Search ..... 109/49, 109/8, 42, 95, 96, 97, 98, 152
See application file for complete search history.

(56) References Cited

U.S. PATENT DOCUMENTS

| | | | | |
|---|---|---|---|---|
| 577,145 | A * | 2/1897 | McKeag | 108/49 |
| 790,217 | A * | 5/1905 | Mason | 108/1 |
| 1,217,676 | A | 2/1917 | Wilson | |
| 1,256,498 | A | 2/1918 | Baker | |
| 1,797,847 | A | 3/1931 | Vandagriff | |
| 1,862,237 | A | 6/1932 | Pepler | |
| 1,894,991 | A * | 1/1933 | Hayes | 108/49 |
| 2,026,011 | A * | 12/1935 | Wright | 108/49 |
| 2,460,244 | A * | 1/1949 | Strauss | 108/49 |
| 2,483,920 | A | 10/1949 | McLean et al. | |
| 2,535,112 | A * | 12/1950 | Woody | 108/49 |
| 2,605,155 | A | 7/1952 | Lewis | |
| 2,692,806 | A * | 10/1954 | Grace | 108/49 |
| 3,118,399 | A * | 1/1964 | Sarkus | 108/49 |
| 3,543,312 | A * | 12/1970 | Pofferi | 108/49 |
| 4,404,698 | A | 9/1983 | Koncelik et al. | |
| 4,780,919 | A | 11/1988 | Harrison | |
| 5,279,010 | A | 1/1994 | Ferrand et al. | |
| 5,653,499 | A * | 8/1997 | Goodall | 297/170 |
| 6,796,536 | B1 * | 9/2004 | Sevier, IV | 248/121 |

FOREIGN PATENT DOCUMENTS

DE 3742813 A1 * 7/1989

* cited by examiner

*Primary Examiner*—Jose V. Chen
(74) *Attorney, Agent, or Firm*—Barnes & Thornburg LLP

(57) ABSTRACT

An overbed table or the like having a base for mounting on a bed frame, a first arm, a second arm, and a table is provided. The first arm pivots relative to the base and the second arm pivots relative to the first arm. A pivot lock can be positioned between the base and the first arm, the pivot lock locking against pivoting movement of the first arm relative to the base. The table can pivot relative to the second arm about a vertical axis, and in one embodiment, the table can pivot about the second arm's longitudinal axis such that the table can assume a substantially vertical position.

31 Claims, 4 Drawing Sheets

FRAME MOUNTED OVERBED TABLE

The present invention relates to devices such as overbed tables. More particularly, the present invention relates to frame mounted overbed tables that are configured for movement relative to a patient support such as a hospital bed.

BACKGROUND

A number of different types of overbed tables are known. There are, for example, the overbed tables illustrated and described in U.S. Pat. Nos. 5,473,997, 4,715,295, 3,854,428, 2,357,588, 2,352,837, 2,346,919, and 2,329,902; and U.S. patent application Ser. No. 10/211,451, the disclosures of which are hereby incorporated herein by reference.

SUMMARY OF THE INVENTION

The present invention comprises one or more of the following features or combinations thereof. An overbed table or device is supported on a base that is mounted in a selected fixed position on the frame of a bed. The table is movable between a position in front of the patient and a position at the foot end of the bed. The device may comprise a base for mounting on a bed frame, a first arm, a second arm, and a table. The first arm pivots relative to the base and the second arm pivots relative to the first arm. A lock or pivot lock may illustratively be positioned between the base and the first arm, the pivot lock locking against pivoting movement of the first arm relative to the base.

The table may illustratively pivot relative to the second arm about a vertical axis. The table also may illustratively pivot about the second arm's longitudinal axis such that the table can assume a substantially vertical position.

A display may be mounted on the table and may be configured to fold into a storage position, becoming a part of the tabletop surface. The display may be interactive, and may be configured for use by a patient or a caregiver.

The base is illustratively substantially "L"-shaped, and comprises a mount leg for mounting on the bed frame and an extension leg extending outwardly at an angle relative to the mount leg. The pivot lock may illustratively comprise a handle for movement between a locked position and an unlocked position, the unlocked position permitting movement of the first arm relative to the base. The pivot lock can be placed in the locked position when the first arm extends at 0 and 90-degree angles relative to the patient support device frame.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
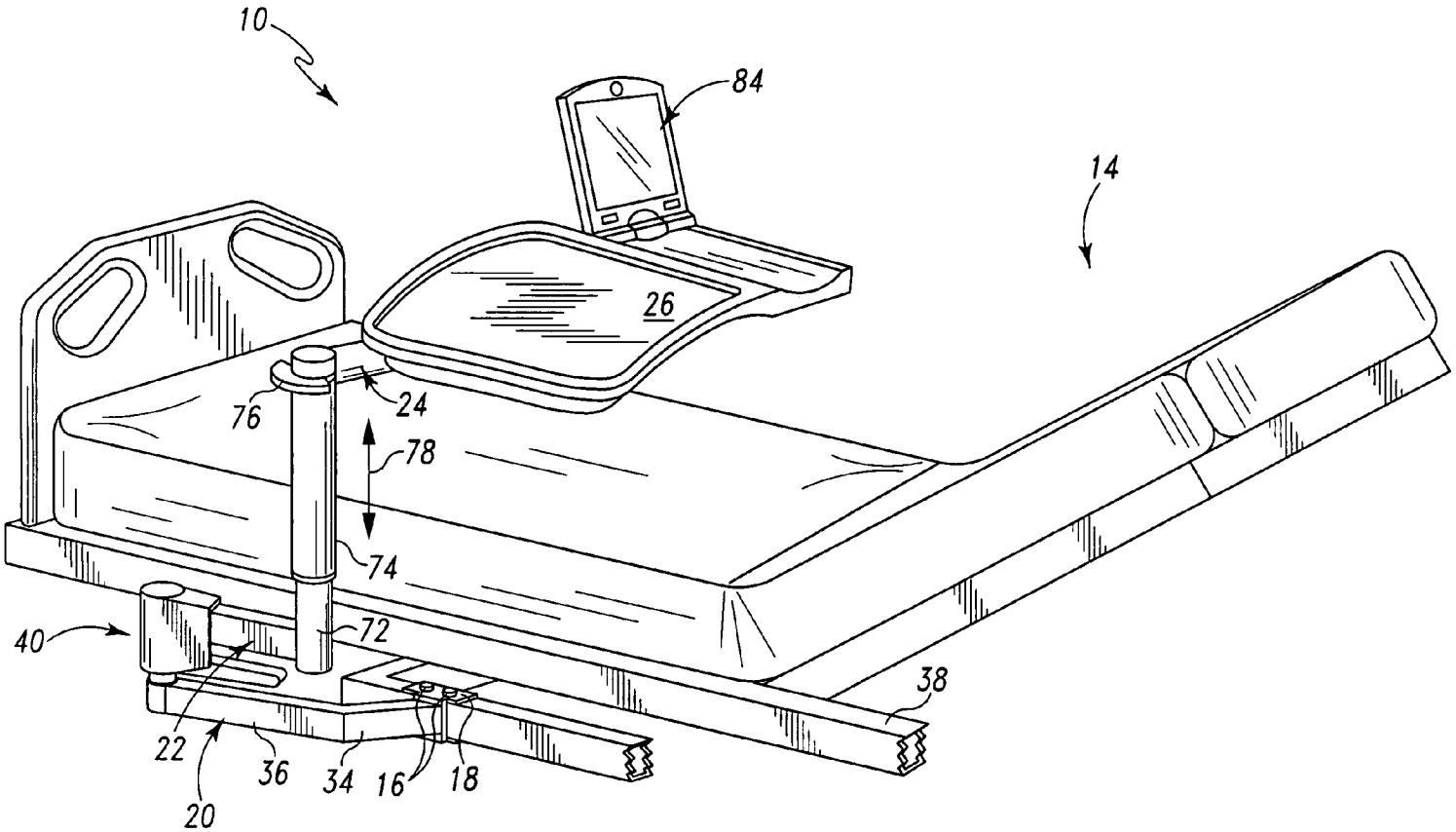
FIG. 1 illustrates a perspective view of an overbed table that is mounted on a frame of a patient support device, i.e. a hospital bed.

An overbed table 10, as shown in FIG. 1, is mounted on frame 12 of a patient support device 14. Illustratively, overbed table 10 is mounted on frame 12 with fasteners 16 and a bracket 18, as can be seen in FIGS. 1–3, however, it should be understood that other constructions and mounting methods are within the scope of the disclosure.

Figure 2:
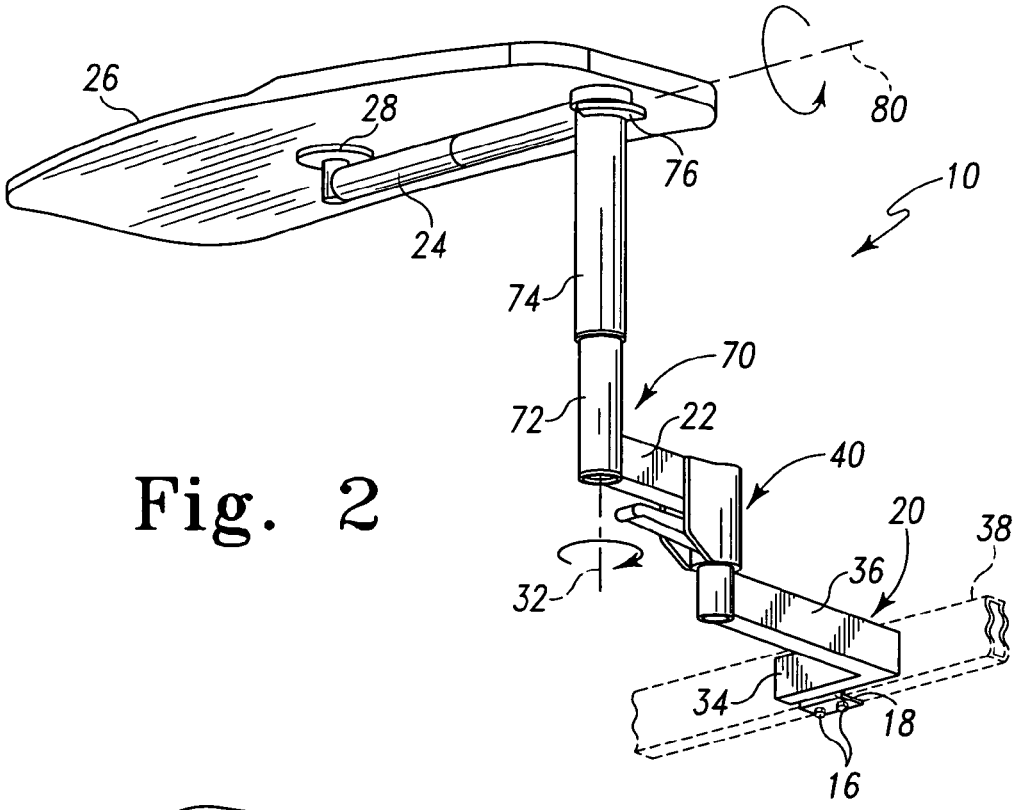
FIG. 2 illustrates a perspective view from below the table, illustrating the appendages that allow for movement and support of the table.
Figure 3:
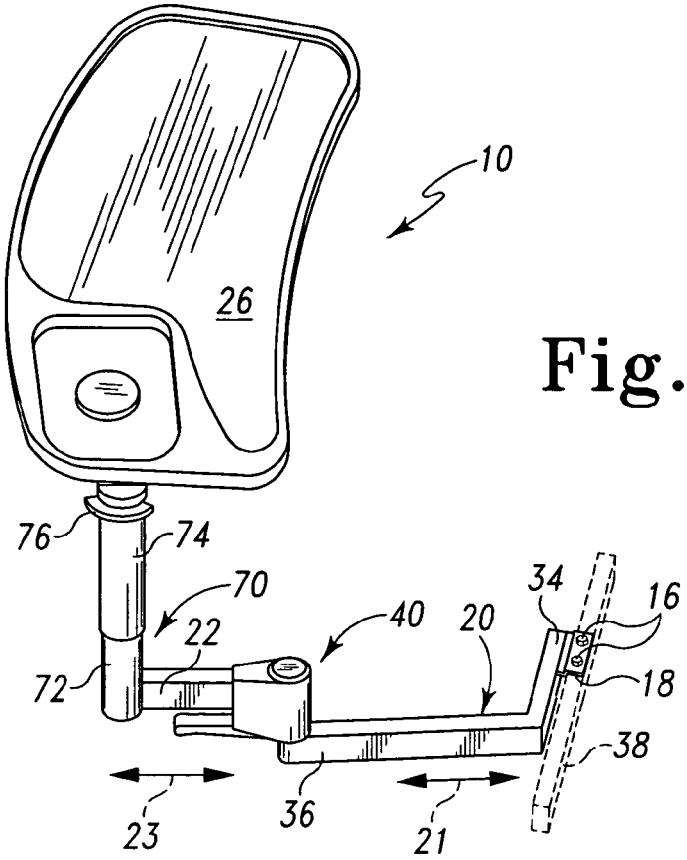
FIG. 3 is a top perspective view similar to that of FIG. 2.

Overbed table 10, as shown in FIG. 2-3, includes a base 20, a first arm 22 pivotably mounted to base 20, and a second arm 24 pivotably mounted to first arm 22. Base 20 is mounted at a selected fixed longitudinal position, with considerations being made for the particular configuration of frame 12 and the desired range of movement of overbed table 10. A tabletop 26 is illustratively coupled to second arm 24 at a substantially central portion on the bottom of tabletop 26, indicated generally by the number 28 (FIG. 2).

In the illustrative constructions of overbed table 10, overbed table 10 can be moved between a position near the foot of the patient support device to a patient-use position, shown in FIG. 1 (and in phantom in FIG. 6), wherein tabletop 26 is in front of the patient's upper body. Additionally, tabletop 26 may be pivoted away from patient support device 14 for use by a care giver (not shown). Such movement is facilitated by the pivoting of second arm 24 about vertical axis 32 relative to first arm 22, and the pivoting of first arm 22 about vertical axis 30 relative to base 20. Attaching an overbed table 10 directly to a frame member 38 frees floor space around a patient support device 14, and prevents hang-ups that could occur from conventional overbed tables having supportive bases positioned under the patient support device, thereby facilitating the patient's control of the overbed table 10.

In the illustrative embodiments, base 20 comprises a mount leg 34 and an extension leg 36 that extends at an angle relative to mount leg 34. As shown in the illustrative embodiment of FIGS. 1 and 6, extension leg 36 extends substantially parallel to a longitudinal frame member 38 of patient support device frame 12, and a channel 40 is formed between extension leg 36 and frame member 38. Illustratively, channel 40 opens toward the foot end of patient support device 14.

Another embodiment of base 20 is shown in FIGS. 2-3, wherein extension leg 36 extends substantially orthogonally from mount leg 34. In all of the illustrative embodiments, mount leg 34 and extension leg 36 are formed of tubular beams having rectangular cross-sections, the mount leg 34 and extension leg 36 being welded to each other. It should be understood, however, that other constructions are within the scope of the disclosure, and that the construction of base 20 can be modified as needed depending on the frame to which overbed table 10 will be mounted. For example, base 20 and first arm 22 may be adjustably extensible as indicated by arrows 21, 23, respectively, in FIG. 3. Such extensible adjustment permits flexibility in the use of overbed table 10.

Figure 4:
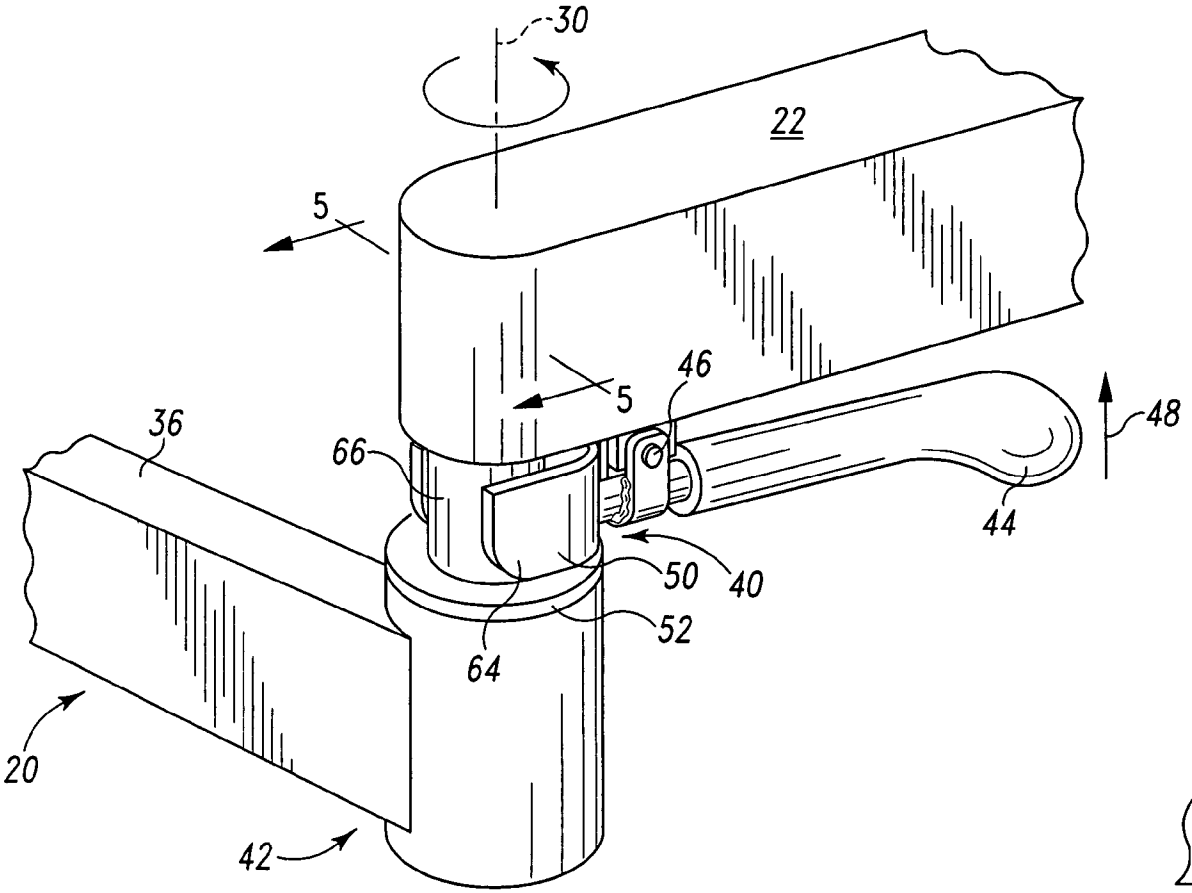
FIG. 4 is an enlarged view of the pivot lock including the handles and lifter coupled thereto.

As can be seen in FIG. 4, a pivot lock 40 is provided between distal end 42 of extension leg 36 and first arm 22. Pivot lock 40 illustratively comprises a handle 44 pivotable about a pivot pin 46 that is coupled to first arm 22. As handle 44 is pulled upwardly in the direction 48, shown in FIG. 4, lifter 50 is caused to pivot about pivot pin 46 and consequently push downwardly on collar 52. Because collar 52 is supported by extension leg 36 of base 20, the downward motion of lifter 50 against collar 52 causes first arm 22 to lift or move vertically upwardly relative to collar 52. Consequently, shaft 54, which is coupled to first arm 22, moves upwardly through bore 56 (which is formed in distal end 42 of extension leg 36).

As shaft 54 is urged upwardly through bore 56, key 58 moves upwardly out of slot 60 and into space 62, wherein key 58 can rotate freely. Illustratively, a second slot (not shown) is formed in distal end 42 of extension leg 36 at a 90° angle relative to slot 60, thereby providing a second locked position wherein rotation of first arm 22 relative to base 20 is prevented.

Figure 5:
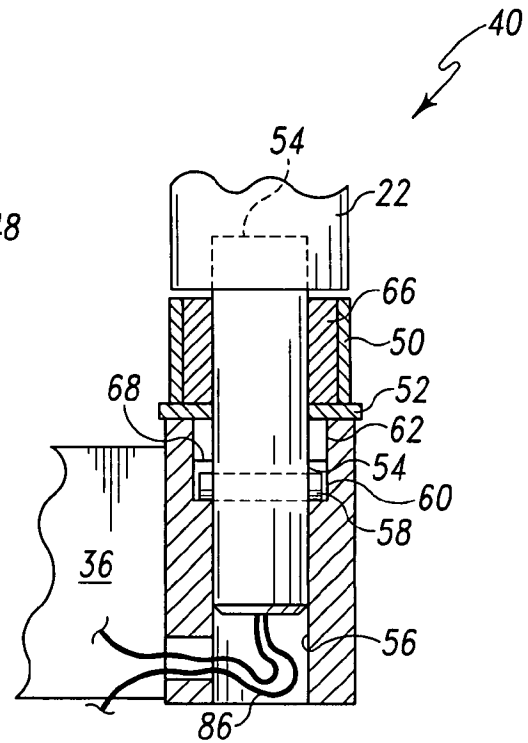
FIG. 5 is a cross-sectional view of the pivot lock.

As can be seen in FIG. 4, lifter 50 is formed to include a rounded corner 64, which facilitates the movement of lifter 50 relative to collar 52 when handle 44 is moved upwardly in the direction 48. Additionally, lifter 50 is substantially horseshoe-shaped such that it embraces central sleeve 66 on at least two sides, as can be seen in FIGS. 4 and 5. Illustratively, when handle 44 is actuated and first arm 22 lifts vertically relative to base 20, first arm 22 is pivotable about vertical axis 30. Upon the release of handle 44, key 58 will rest or slide in space 62 on rim 68 until key 58 passes over a slot such as slot 60, as described above, at which time key 58 drops into the slot.

Pivot lock 40 is configured to lock first arm 22 relative to base 20 such that overbed table can be positioned at the foot of a patient's bed, or above the patient's legs as shown in FIG. 1. Furthermore, pivot lock 40 is also configured to lock first arm 22 in a substantially orthogonal position relative to patient support device frame member 38, as can be seen in FIGS. 2-3, such that overbed table 10 can be used by a care giver standing adjacent the patient support device (not shown).

In the illustrative embodiment, a distal end 70 of first arm 22 has a column 72 attached thereto, as can be seen in FIGS. 2-3. Column 72 is illustratively welded to first arm 22, however it should be understood that other constructions are within the scope of the disclosure. Column 72 extends substantially upwardly from first arm 22, and second arm 24 extends substantially horizontally from column 72. In the illustrated embodiment, second arm 24 includes a downwardly extending sleeve 74. As can be seen in FIG. 1, sleeve 74 moves vertically relative to column 72 in the direction indicated by arrows 78, and vertical lock 76 locks sleeve 74 against vertical movement relative to column 72. Vertical lock 76 may be constructed according to U.S. Pat. No. 4,715,295, or any other method known in the art.

It should be understood that other locks may be used in place of pivot lock 40 and/or vertical lock 76. For example, friction bands, spring wrap clutches, and other selectively lockable devices are capable of use as either of the locks 40, 76 of present disclosure. Each lock may take a variety of forms and permit infinitely variable positioning, or have specific locking positions.

Figure 6:
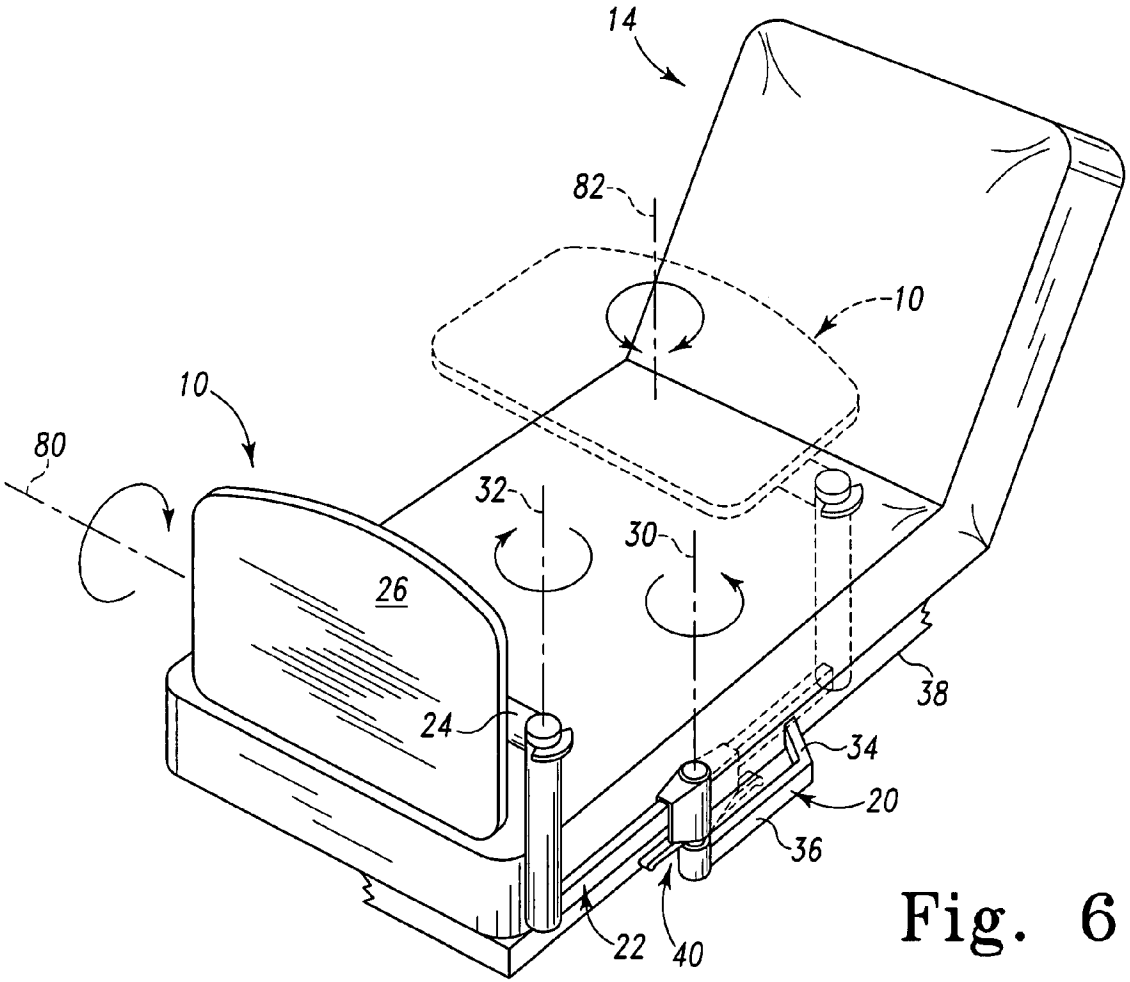
FIG. 6 is a top perspective view of another embodiment of a frame-mounted overbed table, showing the overbed table moved to a footboard position.

Sleeve 74 and column 72 are also illustratively constructed to permit rotation relative to each other about axis 32, as can been seen in FIGS. 2 and 6. Such a construction permits tabletop 26 to be positioned in a variety of locations for additional uses by both the patient and the care giver.

One embodiment of second arm 24, shown in FIGS. 2 and 6, permits rotation about axis 80 such that tabletop 26 can pivot into a foot board position, as shown in FIG. 6. Such a position permits transfer of a patient, or emergency full-body access of the patient. In the horizontal use position, shown in phantom in FIG. 6, tabletop 26 is also rotatable over a range of 350 degrees about vertical axis 82, providing further positions in which tabletop 26 may be located, and permitting the use of tabletop 26 by a caregiver as well as by the patient.

In the embodiment illustrated in FIG. 1, a display 84 is shown integrated into the overbed table 10. Display 84 is illustratively constructed such that it can be folded down and incorporated as a portion of the tabletop 26. In such an embodiment, display 84 may be interactive, may be used as a television screen, or may be configured for additional use by the care giver when tabletop 26 is rotated away from the patient. Further embodiments and constructions for an integrated display 84 can be found in U.S. patent application Ser. No. 10/211,451, filed on Aug. 2, 2002. In such an embodiment, wires 86 can be routed through overbed table 10 and illustratively through pivot lock 40 as can be seen in FIG. 5.

While the disclosure is susceptible to various modifications and alternative forms, specific exemplary embodiments thereof have been shown by way of example in the drawings and have herein been described in detail. It should be understood, however, that there is no intent to limit the disclosure to the particular forms disclosed, but on the contrary, the intention is to cover all modifications, equivalents, and alternatives falling within the spirit and scope of the disclosure as defined by the appended claims.

There is a plurality of advantages of the present invention arising from the various features of the overbed table described herein. It will be noted that alternative embodiments of the overbed table of the present invention may not include all of the features described yet still benefit from at least some of the advantages of such features. Those of ordinary skill in the art may readily devise their own implementations of an overbed table that incorporate one or more of the features of the present invention and fall within the spirit and scope of the present invention as defined by the appended claims.

The invention claimed is:

1. An overbed table comprising:

a base configured to mount on a patient support device frame, a first arm coupled to the base to extend substantially horizontally from the base, the first arm having a mount end and a distal end, the mount end being pivotable relative to the base about a substantially vertical first axis, a lock coupled to the first arm to selectively lock the pivotable movement of the first arm relative to the base, a column extending vertically from the distal end of the first arm, the column having an upper and a lower portion, a second arm pivotable relative to the upper portion of the column about a substantially vertical second axis, the second arm being vertically movable relative to the column, a table carried by the second arm and pivotable relative to the second arm about a third axis that extends through a generally central portion of the table, and a display mounted on the table, the display being movable between a patient-use position, a caregiver-use position and a storage position, wires for the display being routed through one or more of the base, the first arm, the lock, the column, the second arm, and the table.

2. The overbed table of claim 1, further comprising a lock coupled to the second arm to lock against vertical movement of the second arm relative to the column.

3. The overbed table of claim 1, wherein the display comprises an interactive display.

4. The overbed table of claim 1, wherein the base is substantially L-shaped and comprises a mount leg to be mounted on the patient support device frame and an extension leg extending outwardly at an angle relative to the mount leg.

5. The overbed table of claim 1, wherein the lock comprises a handle movable between a locked position, wherein the first arm is locked from pivoting movement relative to the base, and an unlocked position, wherein the first arm is pivotable relative to the base.

6. The overbed table of claim 1, wherein the lock can be selectively locked when the first arm extends substantially at 0 and 90-degree angles relative to the patient support device frame.

7. The overbed table of claim 1, wherein the second arm comprises a sleeve and the column upper portion extends into the sleeve, the sleeve being movable relative to the column upper portion.

8. An overbed table comprising:

a base configured to mount on a patient support device frame, a first arm extending upwardly and outwardly from the base, the first arm being pivotable relative to the base about a first axis, a second arm extending upwardly and outwardly from the first arm, the second arm being vertically adjustable and pivotable relative to the first arm about a second axis, a table carried by the second arm and pivotable relative to the second arm about a third axis disposed substantially perpendicular to at least a portion of the second arm, and a lock coupled to the first arm to lock pivotable movement of the first arm relative to the base about the first axis, the lock having an elongated handle that extends substantially parallel to the first arm and is situated beneath the first arm, the handle being actuatable to allow the pivotable movement of the first arm relative to the base about the first axis.

9. The overbed table of claim 8, wherein the lock comprises a lifter coupled to the handle such that the lifter and the handle are situated on the opposite sides of a pivot pin coupled to the first arm.

10. The overbed table of claim 8, wherein the base is configured to completely support the weight of the overbed table.

11. The overbed table of claim 8, wherein the first arm is pivotable about a vertical axis relative to the base over approximately a 180-degree range.

12. The overbed table of claim 11, wherein the lock is selectively lockable at 90-degree intervals of rotation of the first arm relative to the base.

13. An overbed table comprising:

a base configured to mount on a patient support device frame, a first arm extending upwardly and outwardly from the base, the first arm being pivotable relative to the base, a second arm extending upwardly and outwardly from the first arm, the second arm being vertically adjustable and pivotable relative to the first arm, a table carried by the second arm, a lock coupled to the first arm to lock pivotable movement of the first arm relative to the base, wherein the lock comprises a handle, the handle being actuatable to move the first arm upwardly relative to the base to allow the pivotable movement of the first arm relative to the base.

14. The overbed table of claim 13, wherein the lock comprises a lifter coupled to the handle such that the lifter and the handle are situated on the opposite sides of a pivot pin coupled to the first arm.

15. The overbed table of claim 14, wherein upward movement of the first arm relative to the base causes a locking pin coupled to the first arm to move out of a pin-receiving channel coupled to the base.

16. An overbed table for use with a patient support device having a head end, a foot end and a longitudinal frame member, the overbed table comprising:

a base including a mount leg configured to mount on a patient support device frame and an extension leg that extends at an angle relative to the mount leg, the extension leg being extendible along a longitudinal axis thereof, a first arm coupled to the base to pivot about a first axis, a second arm coupled to the first arm to pivot about a second axis, the second arm being located above the first arm and extending outwardly therefrom, and a table coupled to the second arm to pivot relative to the second arm about a third axis disposed substantially perpendicular to the second arm and to pivot relative to the second arm about a fourth axis disposed substantially parallel to the second arm, and the table being pivotable about the fourth axis between a substantially horizontally disposed tabletop position and a substantially vertically disposed footboard position near the foot end of the patient support device.

17. The overbed table of claim 16, further comprising a lock coupled to the first arm to lock pivotable movement of the first arm relative to the base.

18. The overbed table of claim 17, wherein the lock comprises a handle, and the handle is actuable to move the first arm upwardly relative to the base to allow the pivotable movement of the first arm relative to the base.

19. The overbed table of claim 16, further comprising a lock coupled to the second arm for locking vertical movement of the second arm relative to the column.

20. The overbed table of claim 16, further comprising a display mounted on the table for movement between a patient-use position, a caregiver-use position and a storage position, wires for the display being routed through one or more of the base, the first arm, the second arm, and the table.

21. The overbed table of claim 16, wherein the table is movable to a position substantially in front of the patient's body.

22. An overbed table for use with a patient support device having a head end, a foot end and a longitudinal frame member, the overbed table comprising:

a base having a mount leg configured to be mounted in a selected fixed longitudinal position on the longitudinal frame member and an extension leg that extends at an angle to the mount leg, a first arm coupled to the extension leg to pivot about a first axis, the first arm being pivotable to a position where the first arm extends substantially parallel to the extension leg, a second arm coupled to the first arm to pivot about a second axis, and a table coupled to the second arm to pivot about a third axis, the first, second and third axes being spaced horizontally from each other, and the table being movable between a substantially horizontally disposed tabletop position to be in front of a patient's upper body and a foot end position.

23. The overbed table of claim 22, wherein the first, second and third axes are substantially vertical.

24. The overbed table of claim 22, further comprising a lock coupled to the first arm to selectively lock the pivotable movement of the first arm relative to the base, wherein the lock comprises a handle, and the handle is actuable to move the first arm upwardly relative to the base to allow the pivotable movement of the first arm relative to the base.

25. The overbed table of claim 22, wherein the first arm is further configured to be moved to a position substantially orthogonal to the longitudinal frame member.

26. The overbed table of claim 22, wherein the table is movable to function as a footboard when it is positioned at the foot end position.

27. An overbed table for a patient support having a frame, a head end, and a foot end, the overbed table comprising:

a base mountable on the frame at a selected longitudinal position, a first arm coupled to the base to pivot about a substantially vertical first axis, the first arm extending away from the base, the first arm being extendible along a longitudinal axis thereof, a second arm coupled to the first arm to pivot about a substantially vertical second axis, the second arm extending away from the first arm, and a table coupled to the second arm to pivot about a third axis extending through a generally central portion of the table and coupled to the second arm for pivoting movement about a fourth axis generally perpendicular to the third axis and coincident with a longitudinal centerline of the second arm.

28. The overbed table of claim 27, wherein the first arm extends substantially horizontally from the base toward either the head end or the foot end.

29. The overbed table of claim 27, further comprising a lock coupled to the first arm to selectively lock the pivotable movement of the first arm relative to the base.

30. The overbed table of claim 29, wherein the lock comprises a handle, and the handle is actuable to move the first arm upwardly relative to the base to allow the pivotable movement of the first arm relative to the base.

31. The overbed table of claim 27, wherein the second arm is vertically adjustable relative to the base.

* * * * *